US007500543B2

(12) United States Patent
Doran

(10) Patent No.: US 7,500,543 B2
(45) Date of Patent: Mar. 10, 2009

(54) SHEAVE WITH TAPER LOCK COUPLER

(76) Inventor: Paul J. Doran, 1017 Princeton Dr., Yardley, PA (US) 19067

( * ) Notice: Subject to any disclaimer, the term of this patent is extended or adjusted under 35 U.S.C. 154(b) by 51 days.

(21) Appl. No.: 11/652,237

(22) Filed: Jan. 11, 2007

(65) Prior Publication Data

US 2007/0274778 A1 Nov. 29, 2007

Related U.S. Application Data

(60) Continuation-in-part of application No. 10/766,310, filed on Jan. 27, 2004, now Pat. No. 7,243,759, which is a continuation-in-part of application No. 10/463,913, filed on Jun. 17, 2003, now Pat. No. 6,681,898, which is a continuation of application No. 09/974,466, filed on Oct. 10, 2001, now Pat. No. 6,578,674, which is a division of application No. 09/490,084, filed on Jan. 24, 2000, now Pat. No. 6,315,080.

(51) Int. Cl.
*B66B 1/00* (2006.01)

(52) U.S. Cl. ..... 187/277; 187/250; 187/289

(58) Field of Classification Search ..... 187/250, 187/289, 270, 277, 411, 413; 310/89, 91, 310/112, 113; 248/637–639, 645, 646, 650, 248/652, 666, 667, 674–681; 403/13, 16, 403/286, 287, 301, 306, 335–337
See application file for complete search history.

(56) References Cited

U.S. PATENT DOCUMENTS 1,517,761 A 12/1924 Sorensen et al.
2,402,743 A 6/1946 Firth
3,324,736 A * 6/1967 Bassoff ..... 474/41
3,883,759 A 5/1975 Mierendorf
3,888,093 A 6/1975 Downey
4,000,793 A 1/1977 Chung
4,089,232 A * 5/1978 Llach et al. ..... 474/28
4,120,388 A 10/1978 Nisley
4,355,785 A 10/1982 Tosato et al.
4,365,964 A 12/1982 Krome, Jr.
D273,116 S * 3/1984 Huff et al. ..... D15/148
D273,197 S * 3/1984 Huff et al. ..... D15/148
4,494,889 A 1/1985 Thompson
4,500,226 A 2/1985 Romand-Monnier et al.
4,525,095 A 6/1985 Lamb et al.
4,578,608 A 3/1986 Mech et al.
4,606,671 A 8/1986 Rasmussen
4,617,004 A * 10/1986 Mott ..... 474/8
5,002,157 A 3/1991 Heikkinen
5,148,893 A 9/1992 Vertesy et al.
5,299,880 A 4/1994 Bouchard
5,433,294 A 7/1995 Walker
5,449,153 A 9/1995 Catalano et al.

(Continued)

*Primary Examiner*—Walter Benson
*Assistant Examiner*—Eduardo Colon-Santana
(74) *Attorney, Agent, or Firm*—Howard IP Law Group

(57) ABSTRACT

A coupling arrangement for coupling a traction sheave on a motor shaft includes a taper lock bushing and a traction sheave having a tapered bore adapted to receive the taper lock bushing. The taper lock bushing is sized to slidingly engage with the motor shaft and to fit into the tapered bore of the traction sheave. The taper lock bushing is fastened onto the traction sheave via threaded fasteners to result in a compression fit between the taper lock bushing and the motor shaft.

7 Claims, 2 Drawing Sheets

U.S. PATENT DOCUMENTS

| | | | | |
|---|---|---|---|---|
| 5,743,140 | A | 4/1998 | Gustafson | |
| 5,772,176 | A | 6/1998 | Keck et al. | |
| 5,850,115 | A | 12/1998 | Grosskopf | |
| 5,939,807 | A | 8/1999 | Patyk et al. | |
| 6,202,507 | B1 | 3/2001 | Phillips | |
| 6,224,289 | B1 | 5/2001 | Redd et al. | |
| 6,315,080 | B1 | 11/2001 | Doran | |
| 6,328,274 | B1 | 12/2001 | Hayashi | |
| 6,378,832 | B1 | 4/2002 | Li et al. | |
| 6,386,844 | B1 | 5/2002 | Chen et al. | |
| 6,398,521 | B1 | 6/2002 | Yorulmazoglu | |
| 6,575,714 | B2 | 6/2003 | Pace et al. | |
| 6,578,674 | B2 * | 6/2003 | Doran | 187/277 |
| 6,681,898 | B1 * | 1/2004 | Doran | 187/277 |
| 6,966,544 | B2 * | 11/2005 | McCormick et al. | 254/342 |
| 7,243,759 | B2 * | 7/2007 | Doran | 187/277 |
| 2001/0026761 | A1 | 10/2001 | Repple et al. | |
| 2002/0100646 | A1 | 8/2002 | Maurice et al. | |
| 2006/0151251 | A1 | 7/2006 | Rennetaud | |
| 2006/0169545 | A1 | 8/2006 | Hisamitsu | |
| 2006/0191301 | A1 * | 8/2006 | Park et al. | 68/140 |
| 2006/0231345 | A1 | 10/2006 | Mustalahti et al. | |

* cited by examiner

SHEAVE WITH TAPER LOCK COUPLER

RELATED APPLICATIONS

This application is a continuation-in-part of U.S. patent application Ser. No. 10/766,310, entitled "Tapered Coupler For Coupling A Motor To A Hoist Machine," filed Jan. 27, 2004, now U.S. Pat. No. 7,243,759 which is a continuation-in-part of U.S. patent application Ser. No. 10/463,913 entitled "Coupling Arrangement for Coupling A Motor to a Hoist Machine", filed Jun. 17, 2003, now U.S. Pat. No. 6,681,898, which is a continuation of U.S. patent application Ser. No. 09/974,466 entitled "Adapter Plate For Mounting A Motor Housing To A Hoist Machine Housing," filed Oct. 10, 2001, now U.S. Pat. No. 6,578,674, which is a divisional of U.S. patent application Ser. No. 09/490,084 entitled "Converter For A Modular Motor To Couple To A Hoist Machine," filed Jan. 24, 2000, now U.S. Pat. No. 6,315,080, the entire disclosures of all of which are hereby incorporated by reference as if being set forth in their entireties herein.

FIELD OF THE INVENTION

The present invention relates generally to electric motors and more particularly to a coupling arrangement for coupling a sheave to an electric motor.

BACKGROUND OF THE INVENTION

Gearless traction elevators driven by electric motors are known in the art. Such elevators are powered by lower speed electric motors, compared to geared traction elevators. In a gearless traction elevator, a traction sheave is directly coupled with a shaft which is rotated by the electric motor. The traction sheave drives one or more cables or ropes which are connected on one end to the elevator and on the other end to a counterweight.

In one known method of coupling a traction sheave to a motor shaft, the traction sheave is rigidly fitted and aligned on the motor shaft via a key on the rotating shaft. The traction sheave may rattle about the motor shaft and result in noisy operation. The motor shaft may also be prematurely damaged because of an improper fit between the traction sheave and the motor shaft and may result in hardening of the exterior of the shaft, thereby making it brittle.

In view of the above, it is desirable to obtain a coupling arrangement for mounting such a traction sheave directly onto a shaft of an electric motor which enables a proper fit between the sheave and the motor shaft, reduces the possibility of damage to the motor shaft, and is less cumbersome.

SUMMARY OF THE INVENTION

A coupling arrangement for coupling a traction sheave to a motor shaft, the coupling arrangement including a taper lock bushing. The tapered bushing has a bore adapted to receive the motor shaft. The coupling arrangement also includes a traction sheave which has a tapered bore. The tapered bore is adapted to receive the taper lock bushing. A plurality of fasteners connects the tapered bushing to the traction sheave.

BRIEF DESCRIPTION OF THE FIGURES

Understanding of the present invention will be facilitated by consideration of the following detailed description of the preferred embodiments of the present invention taken in conjunction with the accompanying drawings, in which like numerals refer to like parts and in which.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, many other elements found in typical methods and systems for coupling an electric motor to a hoist machine. However, because such elements are well known in the art, and because they do not facilitate a better understanding of the present invention, a discussion of such elements is not provided herein. The disclosure herein is directed to all such variations and modifications known to those skilled in the art.

Figure 1:
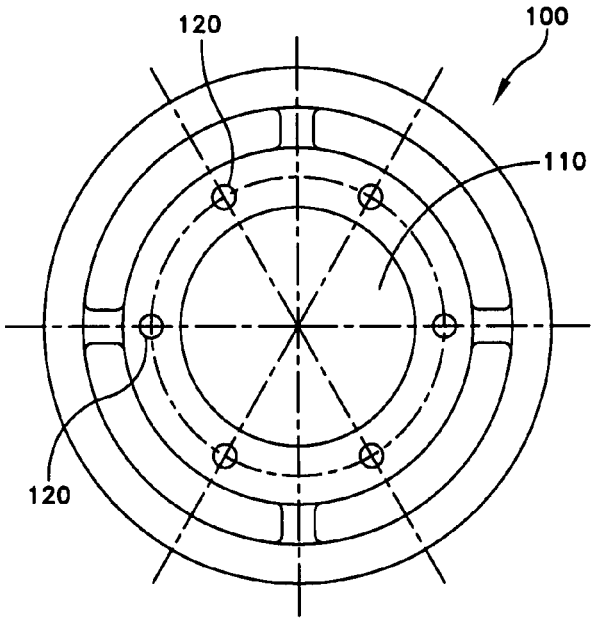
FIG. 1 (PRIOR ART)
FIG. 1 illustrates the top view of an embodiment of a sheave of the present invention.
Figure 3:
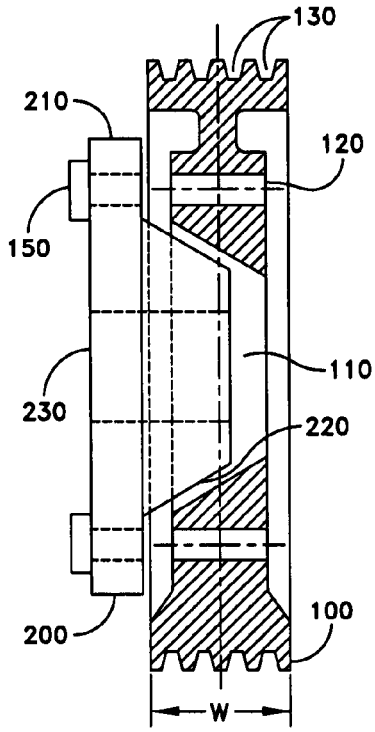
FIG. 3 illustrates the cross-sectional view of an embodiment of the sheave of FIG. 1, along lines 3-3.

Referring now to FIG. 1, a traction sheave 100 is illustrated. At the center of the sheave 100, is a bore 110. In an embodiment of the present invention, a cross-sectional view of which is illustrated in FIG. 3, the bore 110 is adapted to accommodate a motor shaft and a taper lock bushing. The traction sheave 100 has multiple holes 120 adapted to receive bolts or other fasteners. The illustrated holes 120 are radially positioned. The holes 120 may be threaded or non-threaded. The holes 120 may be through holes or may be tap holes. The traction sheave 100 has multiple grooves 130 on its periphery adapted to receive cables or ropes. The grooves 130 are profiled to receive elevator cables or ropes of standards sizes, as are known in the art.

Figure 2:
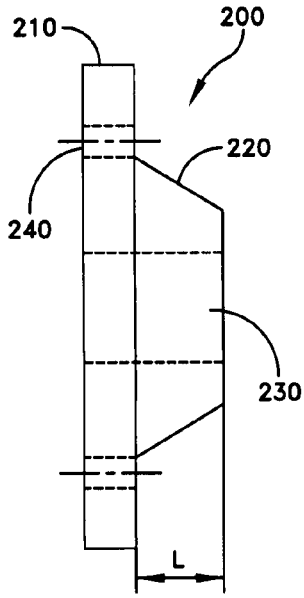
FIG. 2 (PRIOR ART)
FIG. 2 illustrates the side view of an embodiment of a taper lock bushing of the present invention.

Now referring to FIG. 2, a taper lock bushing 200 is shown. Such taper lock bushings are known in the art. The taper lock bushing 200 has a flange-like member 210 and a tapered structure 220. A bore 230 is defined in the flange-like member 210 and the tapered structure 220. The bore 230 is adapted to receive a motor shaft. The tapered structure 220 is adapted to fit into the bore 110 of the sheave 100. The length of the tapered structure 220 L is generally equal to the width W of the traction sheave 100. Multiple through holes 240 are defined in the flange-like member 210. The holes 240 are adapted to receive fasteners such as a bolt 150. The holes 240 are positioned so as to align with the holes 120 in the traction sheave 100.

Figure 4:
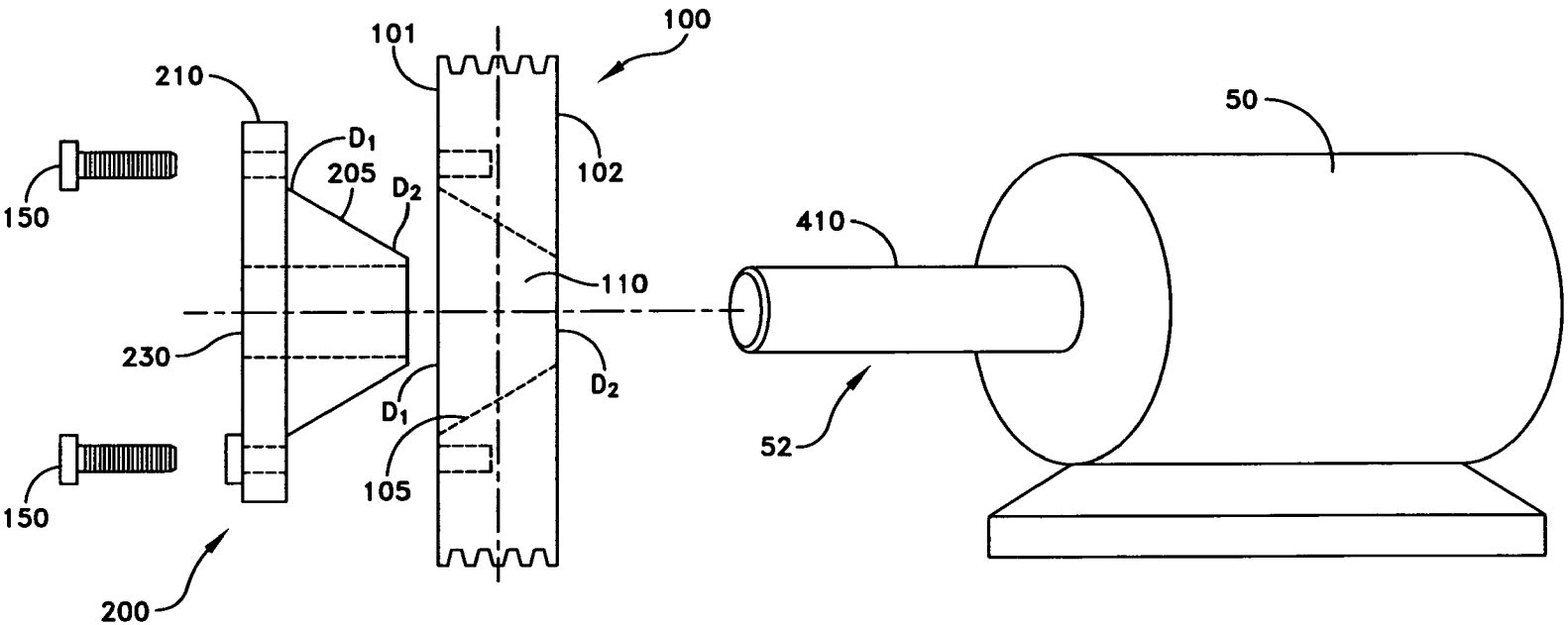
FIG. 4 illustrates the coupling of an embodiment of a sheave onto a motor shaft.

Referring now to FIG. 4, an exemplary method of coupling a traction sheave with a motor shaft, according to the present invention will be described. A motor 50 has a motor shaft 52. A traction sheave 100 is to be coupled to the motor shaft 52 with the help of a taper lock bushing 200. The tractions sheave has a proximal surface 101 and a distal surface 102. The traction sheave generally defines a bore 110 which generally matches the profile of a motor shaft of a given diameter. The bore 110 is adapted to receive the taper lock bushing 200. The bore 110 has interior surface 105. The bore can be so adapted by machining or drilling or other known manufacturing and machining processes. The taper lock bushing 200 has an exterior surface 205 on the tapered structure 220. The taper lock bushing has bore 230 which has a larger diameter D1 adjacent to a flange-like member 210 and a smaller diameter D2 at the opposite end. Similarly, the bore 110 in the traction sheave 100 has a larger diameter D1 at the surface 101 and a smaller diameter D2 at the surface 102.

The taper lock bushing 200 is so selected to have a slide fit with the motor shaft 52. For illustrative purposes only, the slide fit may be 0.003 to 0.005 inches. The traction sheave 100 is mounted on the motor shaft 52. The taper lock bushing 200 is inserted in the bore 110 of the traction sheave and onto the motor shaft 52. In the illustrated embodiment of the traction sheave, the traction sheave 100 has a plurality of tap threaded holes on the surface 101. Fasteners 150 are used to fasten the taper lock bushing to the traction sheave 100. Fasteners 150 may be set screws or bolts or known fasteners. As the fasteners are tightened, the taper lock bushing is further pushed into the bore 110 of the traction sheave 100. The interior surface 105 of the bore 110 exerts compressive forces on the exterior surface 205 of the taper lock bushing 200. These compressive forces transform the initial slide fit between the taper lock bushing 200 and the motor shaft 52 into a compression fit.

If the motor shaft 52 has a tapered profile, the shaft can be machined to a straight profile to couple a traction sheave with the motor shaft using a taper lock bushing.

An aspect of the present invention includes a method for retrofitting an existing traction sheave mounted on a motor shaft. Generally, the motor shaft 52 may have a key 410 to align and mount a traction sheave 100 on the motor shaft. The traction sheave 100 is removed from the motor shaft 52. The bore 110, which is generally circular is machined to have a tapered profile, as shown in FIGS. 3 and 4. The bore 110 is adapted to receive a taper lock bushing 200 by machining or drilling or using other known manufacturing techniques. The traction sheave 100 is then mounted on the motor shaft 52. The taper lock bushing 200 is also mounted on the motor shaft 52 such that it fits into the bore 110 of the traction sheave. Fasteners 150 are used to fasten the taper lock bushing to the traction sheave 100. Fasteners 150 may be set screws or bolts or known fasteners. As the fasteners are tightened, the taper lock bushing is further pushed into the bore 110 of the traction sheave 100. The interior surface 105 of the bore 110 exerts compressive forces on the exterior surface 205 of the taper lock bushing 200. These compressive forces transform the initial slide fit between the taper lock bushing 200 and the motor shaft 52 into a compression fit.

If the motor shaft 52 has a tapered profile, at least a portion of the shaft 52 is straightened up by known machining techniques. The traction sheave 100 having a tapered bore 110 is then mounted onto the straightened portion of the shaft 52. The taper lock bushing 200 is mounted on the motor shaft 52, into the tapered bore 110 of the traction sheave 100. Fasteners 150 are used to fasten the taper lock bushing to the traction sheave 100. As the fasteners are tightened, the taper lock bushing is further pushed into the bore 110 of the traction sheave 100. The interior surface 105 of the bore 110 exerts compressive forces on the exterior surface 205 of the taper lock bushing 200. These compressive forces transform the initial slide fit between the taper lock bushing 200 and the motor shaft 52 into a compression fit.

It will be apparent to those skilled in the art that modifications and variations may be made in the apparatus and process of the present invention without departing from the spirit or scope of the invention. It is intended that the present invention cover the modification and variations of this invention provided they come within the scope of the appended claims and their equivalents.

What is claimed is:

1. A coupling arrangement for coupling a traction sheave to a motor shaft, said coupling arrangement comprising:

a taper lock bushing, said tapered bushing having a bore adapted to receive the motor shaft;

a traction sheave having a tapered bore, said tapered bore adapted to receive said taper lock bushing; and a plurality of fasteners, said plurality of fasteners connecting said tapered bushing to said traction sheave, thereby creating a compression fit between said taper lock bushing and said motor shaft.

2. The coupling arrangement of claim 1, wherein said traction sheave further comprises a plurality of threaded holes to receive said plurality of fasteners.

3. The coupling arrangement of claim 2, wherein said plurality of holes is tap holes.

4. The coupling arrangement of claim 2, wherein said plurality of holes is through holes.

5. A method for coupling a traction sheave to a motor shaft, the method comprising the steps of:

providing a taper lock bushing adapted to slidingly engage with the motor shaft;

providing a traction sheave having a tapered bore adapted to receive said taper lock bushing and the motor shaft;

mounting said traction sheave on the motor shaft;

inserting said taper lock bushing into said tapered bore of said traction sheave such that said taper lock bushing is positioned substantially between the motor shaft and said traction sheave; and fastening said taper lock bushing with said traction sheave, thereby creating a compression fit between said tapered bushing and the motor shaft.

6. A method of retrofitting a traction sheave mounted on a motor shaft having a key, the method comprising the steps of:

unmounting the traction sheave of the motor shaft;

providing a taper lock bushing adapted to slidingly engage with the motor shaft;

adapting the bore of said traction sheave to receive said taper lock bushing;

mounting said traction sheave on the motor shaft;

inserting said taper lock bushing into said tapered bore of said traction sheave such that said taper lock bushing is positioned substantially between the motor shaft and said traction sheave; and fastening said taper lock bushing with said traction sheave, thereby creating a compression fit between said tapered bushing and the motor shaft.

7. The method of claim 6, wherein the motor shaft has a tapered profile, and further comprising the step of:

straightening at least a portion of the motor shaft to form a straight profile, wherein said portion is sufficiently long to receive said taper lock bushing and said traction sheave.

* * * * *